United States Patent [19]

Morini

[11] 4,115,979

[45] Sep. 26, 1978

[54] DEVICE FOR STEPWISE FEEDING A HOSE FOR PACKAGING PRODUCTS, IN PARTICULAR FRUIT AND VEGETABLE PRODUCTS

[76] Inventor: Rino Morini, Via San Francesco, 35, Imola (Province of Bologna), Italy

[21] Appl. No.: 788,489

[22] Filed: Apr. 18, 1977

[30] Foreign Application Priority Data

Apr. 29, 1976 [IT] Italy ..... 3414 A/76

[51] Int. Cl.[2] ..... B65B 41/00

[52] U.S. Cl. ..... 53/393; 226/160

[58] Field of Search ..... 53/138 R, 138 A, 180 M, 53/182 M, 183, 198 A, 389, 393, 193; 226/158, 160, 162–166

[56] References Cited

U.S. PATENT DOCUMENTS 1,396,911 11/1921 Anselmi et al. ..... 226/160

3,607,574 9/1971 Satake ..... 53/183

FOREIGN PATENT DOCUMENTS 2,403,749 7/1975 Fed. Rep. of Germany ..... 53/183

*Primary Examiner*—Robert Louis Spruill

*Attorney, Agent, or Firm*—Guido Modiano; Albert Josif

[57] ABSTRACT

A device for stepwise feeding a hose for packaging products, in particular fruit and vegetable products comprises a frame, pincer gripping jaws swivel supported by the frame, a first jack for moving the gripping jaws between a raised position and a lowered position and a second jack for operating the gripping jaws to grip the lower closed end of a packaging sleeve when the gripping jaws are in the raised position and drag that end downwards and then release it when the gripping jaws are moved to the lowered position.

3 Claims, 3 Drawing Figures

DEVICE FOR STEPWISE FEEDING A HOSE FOR PACKAGING PRODUCTS, IN PARTICULAR FRUIT AND VEGETABLE PRODUCTS

BACKGROUND OF THE INVENTION

This invention relates to a device for stepwise feeding a hose for packaging products, in particular fruit and vegetable products. In packaging certain fruit and vegetable products, in particular citrus fruits, use is made of a sleeve of cotton or synthetic yarn mesh. The hose is superimposed on a tube of suitable diameter which is disposed obliquely and fed from above by a hopper or conveyor. The hose is kept held at the top of the tube by a ring acting as a brake, while an end portion thereof extends beyond the lower end of the tube and is closed by a clip so as to obstruct the lower discharge aperture of the tube. In practice a bag is obtained into which a certain quantity of products conveyed by the tube is inserted and which is then closed in a subsequent operation by a second clip. Suitable members feed the hose along the tube by a predetermined amount to give rise to the next pack. At the present time these means comprise a pair of jaws which, by means of control members, are firstly disposed against the tube so as to clamp the hose against it at diametrically opposite points, and are then moved along the tube by a predetermined amount to produce below the lower end of the tube a bag of sufficient size for containing the required quantity of products. It has been found that the stepwise feeding of the hose is not always perfect because the hose, for various reasons such as excessive jaw pressure, roughness of the outer tube surface etc., does not slide uniformly and bags are formed of even considerably different lengths. The result is that on closing the bag, if the bag is short then excessive tension is created on the products or the hose may even break, and if the bag is long then the products have excessive freedom of movement, independently of any consideration of the operational effectiveness of the known devices.

SUMMARY OF THE INVENTION

The object of the present invention is to propose a device for stepwise feeding a hose for packaging products in which the feed step is positively controlled and does not depend on variable factors such as the instantaneous condition of the sliding surfaces, coefficients of friction and the like.

A further important object of the present invention is to provide a structurally simple device of high operational reliability which is widely flexible in use, in particular in relation to the various bag diameters to be obtained.

These objects are attained by a device for stepwise feeding a hose for packaging products, in particular fruit and vegetable products comprising a frame, pincer gripping members swivel supported by said frame, means for moving said gripping members between a raised position and a lowered position, and means for operating said gripping members so that they grip the lower closed end of a packaging hose when the gripping members are in the raised position and drag said end downwards and then release it when the gripping members are moved into the lowered position.

BRIEF DESCRIPTION OF THE DRAWINGS

Further characteristics will be more evident from the detailed description given hereinafter of a preferred embodiment of the invention, illustrated by way of example in the accompanying drawings in which.

DESCRIPTION OF THE PREFERRED EMBODIMENTS

Figure 1:
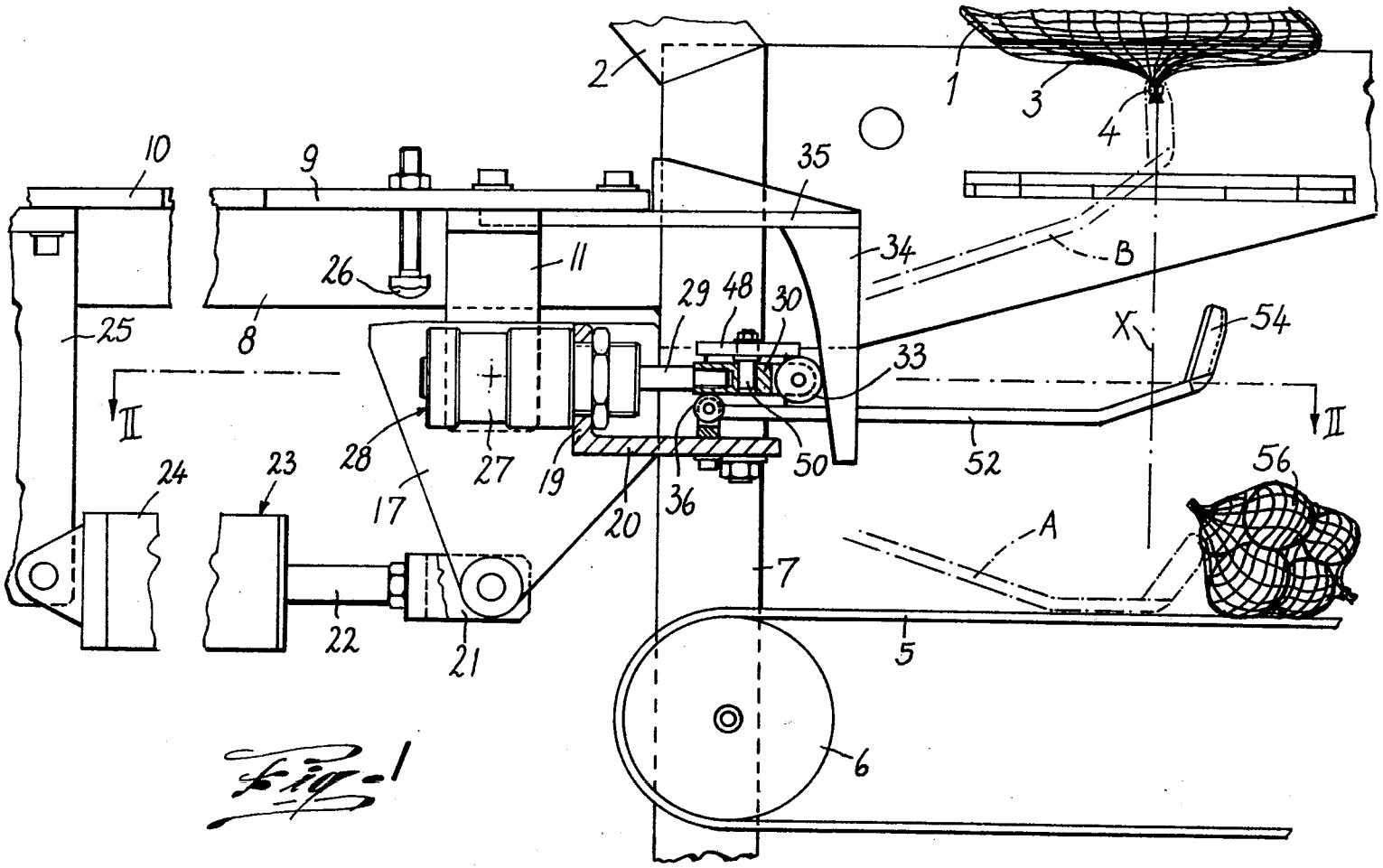
FIG. 1 is an elevation of the device according to the invention on the plane I—I of FIG. 2.

In the embodiment illustrated, it is assumed that the device is associated with a bag filling machine for citrus fruits. As already stated in the introduction, such bag filling machines comprise a tube 1 supported obliquely by a frame 2 (in a manner not shown on the drawing but in accordance with normal practice) and with its lower outlet mouth on the vertical axis X. A mesh sleeve or hose 3 is superimposed on the tube 1 and closed by a suitable ring 4 fixed by a folding machine immediately below the outlet mouth of the tube 1, so as to obstruct this latter. The problem which the device according to the invention is required to solve is the formation of a bag of suitable length below said outlet mouth by withdrawing a predetermined length of the hose or sleeve 3 from the tube 1. The bag is then filled with citrus fruit conveyed into it by the tube 1 and is closed upperly by a further ring similar to the ring 4. In practice, in the filling machine the bag is closed at the top with two superimposed rings, the lower ring of which is the ring which closes the mouth of the bag into which the products were inserted, whereas the upper ring is the ring which closes the bottom of the next bag. Suitable cutting means then cut the hose between the two rings so that the bag containing the products falls on to an underlying conveyor belt 5 which turns on a roller 6 supported rotatable in columns 7 of the frame.

Horizontal longitudinal members 8 connected together by cross membes 9, 10 are welded to the columns 7. Two right angled brackets 11, 12 are fixed lowerly by screws to the cross member 9 and, in their vertical portions, rotatably support, via bearings 13, 14, respective pivots 15, 16 aligned on a horizontal axis. Two parallel plates 17, 18 are fixed to the pivots 15, 16 and are connected together by a bridge of L cross-section forming a rib 19 and a bracket 20 which projects from the lower edge of the rib 19 towards the X axis and lies in a plane overlying the upper surface of the belt 5.

The plate 17 is of substantially triangular shape with a low vertex. To this vertex there is hinged a fork 21 fixed to the end of a rod 22 of a hydraulic jack 23, the cylinder 24 of which is hinged to a bracket 25 bolted lowerly to the cross member 10. It is evident than on operating the jack 23, the plates 17, 18 rotate about the pivots 15, 16 and the bracket 20 thus swivels. To limit the swivel of the bracket 20 there is provided an adjustable limit stop 26 against which the upper edge of the plate 17 strikes.

To the rib 19 of the bridge connecting together the plates 17, 18 there is flanged the cylinder 27 of a second hydraulic jack 28, to the rod 29 of which there is fixed a member 30. This member comprises a portion containing an elongated slot 31 which extends in a direction perpendicular to the axis of the rod 29. From that end of the member 30 which is not connected to the rod 29 there derive two projections traversed by a pin 32 carrying an idle roller 33 constituted by a rolling bearing. The periphery of the roller 33 is engaged with the contour of a cam 34 which projects downwards from a bracket 35 fixed below the cross member 9. The member 30 rest by its lower surface on a roller 36 idly supported between the arms of a bracket 37 rigid with the bracket 20.

On the bracket 20, to the sides of the member 30, there are disposed two pins 38, 39 fixed normal to the plane of the bracket and on which bushings 42, 43 are supported via bearings 40, 41. The bearings 40, 41, between which spacers are disposed, are retained on the respective pins 38, 39 by end plates 44, 45 fixed by screws. The bushing 42, 43 are locked on the bearings by circlips 46, 47.

To the upper edges of the bushes 42, 43 there are welded two respective radial levers 48, 49, with pegs 50, 51 rigid with their ends and engaging in the slot 31. Arms or levers 52, 53 projecting below the tube 1 are welded to the lower edges of said bushes 42, 43. The arms 52, 53 are of arched shape so that when spaced apart they allow the bag containing the products to descend, and are provided at their free ends with jaws 54, 55 which operate in the manner of jaws of a pincer grip.

The operation of the device is evident from the description given. It will be assumed that the operation starts from the position of FIG. 1, in which a pack 56 of products has just been deposited on the belt 5 and a new bag has to be prepared below the outlet mouth of the tube 1.

Figure 2:
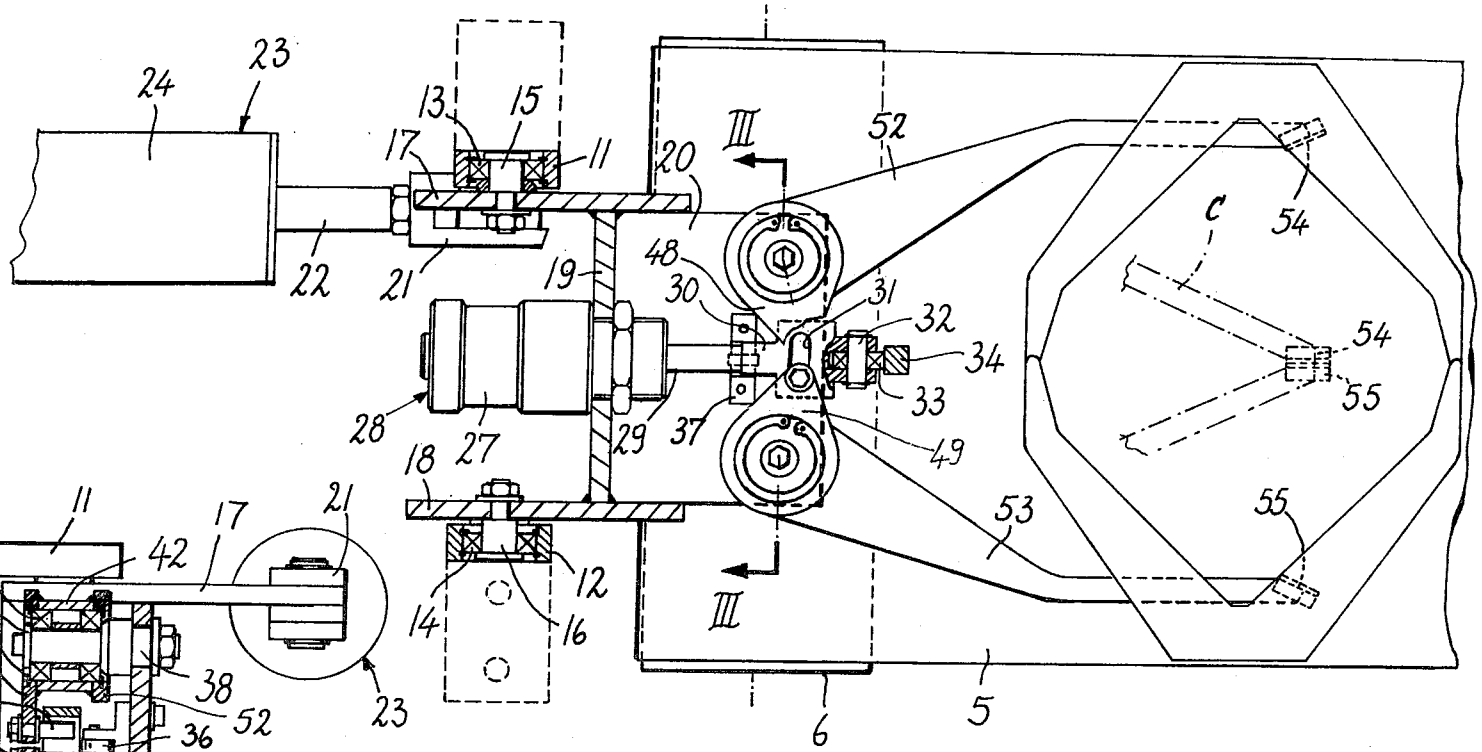
FIG. 2 is a plan view on the plane II—II of FIG. 1.
Figure 3:
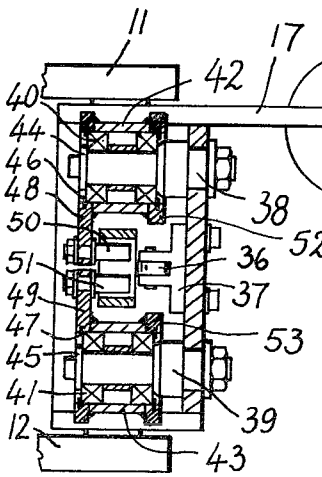
FIG. 3 is an elevation on the plane III—III of FIG. 2.

The arms 52, 53 are in the lowered position indicated by dashed lines with A and skim the belt 5. By operating the jack 23, with consequent rotation of the baracket 20, the arms 52, 53 are brought into the raised position B. The jack 28 is then operated, the rod 29 of which withdraws to cause the arms 52, 53 to approach each other and take up position C of FIG. 2. The jaws 54, 55 then close on to the lower closed end of the hose 3 to grip it firmly. At this point, the jack 23 is operated so that it shortens and withdraws the hose 3 from the tube 1 by a portion equal to the vertical stroke of the jaws 54, 55 less any elastic return of the mesh used to form the sleeve.

When the jaws 54, 55 have reached the lower end of their stroke, the jack 28 extends and the formed bag is released. After filling the bag with a quantity of citrus fruit conveyed through the tube 1, closing and detaching the filled bag and allowing the bag to fall on to the belt 5, the initially described condition is again attained and the cycle is then repeated in the same manner.

In order to reduce the closing time for the jaws 54, 55 and at the same time reduce the idle time of the device, during their movement from position A to position B the jaws 54, 55 are drawn together by the aid of the cam 34, by means of which the member 30 is moved towards the cylinder 27 to cause the arms 52, 53 to partially rotate towards the closed position. The bending stresses on the rod 29 due to the vertical component of the reaction force arising by the engagement of the roller 33 against the cam 34 are effectively discharged on to the support roller 36.

It is apparent that the invention perfectly attains the proposed objects. In particular, the required portion of the hose 3 is withdrawn positively by the pincer grips 52–55, the movement of which determines its exact length.

It is evident that the stroke of the grips may be adjusted very simply by setting the position of the stop 26 against which the upper edge of the plate 17 strikes.

Numerous modifications may be made to the practical embodiment of the invention, all of which fall within the scope of the inventive idea.

Thus the levers 52, 53 may be made to open and close by means other than those described and illustrated, for example by using a gear comprising a rack moved by a jack and engaging with toothed sectors rigid with said levers.

Likewise, instead of being controlled by their own actuator, the arms 52, 53 may be raised and lowered by levers, the motion of which is derived from the drive members of the bag filling machine.

I claim:

1. A device for stepwise feeding a hose having a lower closed end for packaging fruit and vegetable products, comprising a frame, a bracket rotatably supported on said frame about a horizontal axis, a pair of arms pivoted on said bracket about respective axes perpendicular to said horizontal axis, said arms having free ends provided with jaws, a first hydraulic jack acting between said frame and said bracket for rotating the arms between a raised position in which said jaws are arranged beneath said closed end of the hose and a lowered position in which said jaws are arranged above a removing conveyor, a second hydraulic jack mounted on said bracket for operating said arms so as to cause said jaws to grip the lower closed end of the hose when the arms are in raised position and to release said closed end, when the arms are in lowered position.

2. A device as claimed in claim 1 wherein said second hydraulic jack comprises a cylinder fixed to the bracket and a rod extending outwardly therefrom between said arms, the device further comprising a member fixed on said rod, an elongated slot formed in said member and perpendicular to the rod, pegs engaging said slot and fixed to the ends of the arms opposite to those provided with jaws.

3. A device as claimed in claim 2 comprising a roller supported on said member about a horizontal axis, a cam lying in a vertical plane and having a contour on which said roller is in engagement, said contour being such as to cause the jaws to approach during movement of said arms from the lowered position to the raised position.

* * * * *